US005606813A

United States Patent [19]

Cornu et al.

[11] Patent Number: 5,606,813

[45] Date of Patent: Mar. 4, 1997

[54] MARKER DEVICES

[75] Inventors: Hervé Cornu, Rouxmesnil Bouteilles; Loïc Le Bihan, Rouen; Jean-Pierre Robbes, Sotteville les Rouen, all of France

[73] Assignee: Legrand, Limoges, France

[21] Appl. No.: 194,326

[22] Filed: Feb. 8, 1994

[30] Foreign Application Priority Data

Feb. 19, 1993 [FR] France ..... 93 01896

[51] Int. Cl.[6] ..... G09F 3/04

[52] U.S. Cl. ..... 40/316

[58] Field of Search ..... 40/316

[56] References Cited

U.S. PATENT DOCUMENTS

| | | | |
|---|---|---|---|
| 4,649,658 | 3/1987 | Sarton et al. | 40/316 |
| 4,662,094 | 5/1987 | Jaffe | 40/316 |
| 5,117,570 | 6/1992 | Morosini | 40/316 |
| 5,187,887 | 2/1993 | Mori et al. | 40/316 |

FOREIGN PATENT DOCUMENTS

| | | |
|---|---|---|
| 0121454 | 10/1984 | European Pat. Off. . |
| 2625824 | 7/1989 | France . |
| 0883005 | 7/1953 | Germany . |
| 9010284 | 9/1990 | WIPO . |

*Primary Examiner*—Kenneth J. Dorner
*Assistant Examiner*—Cassandra Davis
*Attorney, Agent, or Firm*—Young & Thompson

[57] ABSTRACT

A marker device includes a support adapted to receive an identifying message and at least one fixing member integral with this support for attaching the combination to an item to be marked. Two marker devices are detachably paired enabling conjoint composition of the identifying messages they are two carry. The device is applicable to identifying both ends of the same electrical installation cable.

19 Claims, 3 Drawing Sheets

MARKER DEVICES

BACKGROUND OF THE INVENTION

1. Field of the Invention

The present invention is generally concerned with marker devices used to identify objects such as cables in an electrical installation which interconnect equipment of any kind and the electrical apparatus controlling the equipment.

It is more particularly concerned with marker devices of this kind which include a support adapted to receive an identifying message and at least one fixing member in one piece with the support for fixing the combination to a cable to be identified.

2. Description of the Prior Art

For example, the identifying message is formed by one or more ring-like markers engaged on the support when this is a simple bar or inserted in the support when it is a sheath of some kind.

Alternatively, it can be formed by one or more U-shape members ("jumpers") which are clipped transversely to the support in a side by side arrangement.

Alternatively, the identifying message can be carried by a strip to be inserted in the support, if the latter forms a sheath, or printed directly on it.

The fixing member is usually provided at one or both ends of the support and can be limited to two holes through which a cable tie can be passed, for example.

Alternatively, it can incorporate a cable tie which is in one piece with it.

It is obviously important for both ends of the same cable to carry the same identifying message.

A general object of the present invention is an arrangement intended to facilitate marking.

SUMMARY OF THE INVENTION

In a first aspect the invention consists in a marker device comprising a support adapted to receive an identifying message and at least one fixing member in one piece with said support for attaching the combination to an item to be marked, said marker device being detachably paired with another marker device.

The marker device in accordance with the invention can be in one piece with the other marker device, for example, to which it is attached by a fragile link.

Being fastened together from the outset, the two markers devices for identifying the two ends of the same cable can advantageously be processed at the same time when applying the necessary identifying messages, which has the advantage of minimizing the risk of any disparity between these identifying messages.

Thereafter the two marker devices processed at the same time are separated from each other.

According to a subsidiary feature of the invention, if the two marker devices are initially connected together by a fragile link, this fragile link constitutes a hinge area enabling the two marker devices to be superposed when making up the identifying messages that they are to carry, especially if the marker devices are at least of the same type, if not identical.

The marking operations to be performed are advantageously facilitated and made more reliable, especially if the identifying messages are made up of markers which, initially part of a necklace from which they can be detached, are designed to clip transversely to the supports.

The marker devices according to the invention being superposed with their respective supports back to back, the combination is applied transversely to the necklace of markers and rotated through one turn relative thereto in a winding movement which, on each half-turn, deposits one marker onto the support of the marker device then in contact with the necklace of markers.

In another aspect the invention consists in a method of using one such marker device paired with another such marker device wherein to apply to said marker devices to make up an identifying message clip-on markers initially arranged in a necklace from which they are detachable said marker devices are superposed with their respective supports back to back, the combination is applied transversely to said necklace of markers and rotated by one turn relative to the latter in a winding movement which, on each half-turn, deposits one marker on said support of said marker device then in contact with said necklace of markers.

In a third aspect the present invention consists in a marker including a median part and two lateral branches each having on its interior surface and projecting towards the other a bead for clipping it onto a marker device comprising for this purpose a support whose edges form shoulders adapted to such clipping, wherein, for use of the above method, its two lateral branches each have projecting from its inside surface a bead with a globally convex cross-section.

The markers are advantageously detached more easily by rolling on their respective beads.

Other things being equal, the present invention has the advantage of enabling a significant time saving as compared with the application of prior art marker devices of the same type.

The objects, features and advantages of the invention emerge from the following description given by way of example with reference to the appended diagrammatic drawings.

DETAILED DESCRIPTION OF THE PREFERRED EMBODIMENTS

Figure 1:
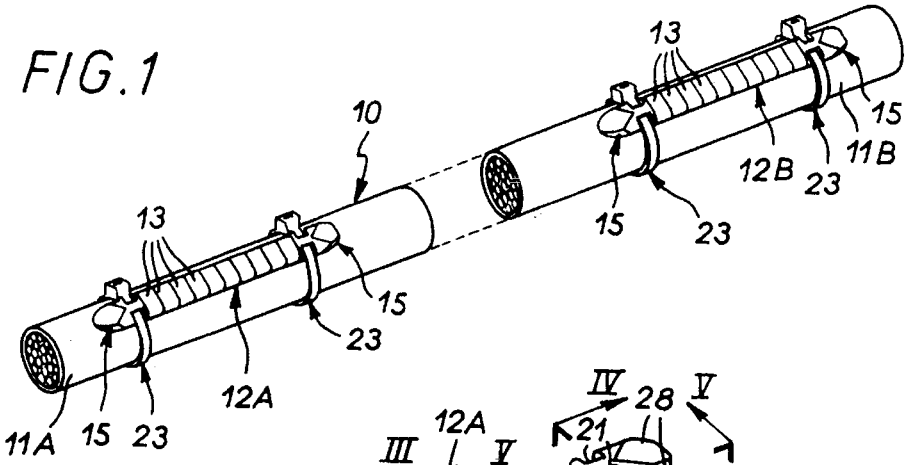
FIG. 1 is a partial perspective view of a cable each end of which is fitted with a marker device according to the invention.
Figure 2:
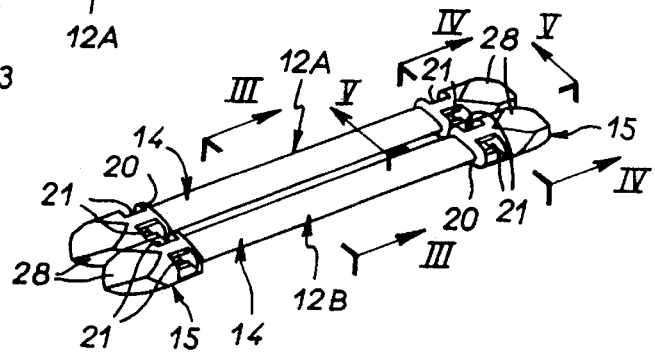
FIG. 2 is a perspective view of a marker device according to the invention detachably paired with another identical marker device.
Figure 3:
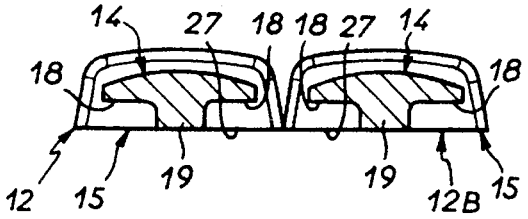
FIGS. 3 and 4 are views of this combination to a larger scale and in transverse cross-section on the respective lines III—III and IV—IV in FIG. 2.
Figure 4:
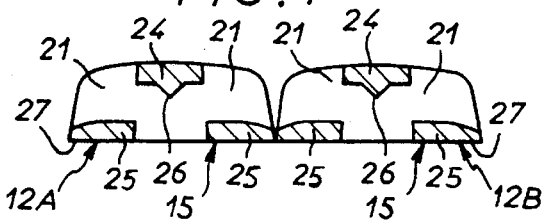

FIGS. 1 through 11 show the application of the invention to a cable 10 to be marked, i.e. identified, by applying to each end 11A, 11B of the cable a marker device 12A, 12B carrying the same identifying message.

The identifying message is made up of markers 13 disposed side by side.

The two marker devices 12A, 12B used for the same cable 10 each include a support 14 adapted to receive at least one marker 13 and at least one fixing member 15 in one piece with the support 14 for attaching the combination to the cable 10.

According to the invention, and by virtue of arrangements described in more detail below, the marker device 12A, for example, is detachably paired with another marker device, in this instance the marker device 12B. Preferably, and as shown here, the other marker device 12B is another marker device of the same type.

In practise it is identical to the marker device 12A.

The support 14 of these marker devices 12A, 12B is elongate so that it can be disposed longitudinally along a generatrix of the cable 10. It has a fixing member 15 at each end.

The support 14 is in the form of a bar whose upper surface has a slightly convex profile in transverse cross-section and the lower surface of the parallel edges of which form two longitudinal shoulders 18 onto which a marker 13 can be clipped transversely, as described below.

In the embodiments shown in FIGS. 1 through 10 the support 14 has a rounded upper surface in transverse cross-section.

The support 14 has a longitudinal stiffener rib 19 projecting from the middle part of its lower surface, between the shoulders 18.

Each fixing member 15 forms a projecting guard 20 at one end of the support 14 for longitudinal retention of the markers 13.

Each fixing member 15 also has two holes 21 through which a cable tie 23 can be passed.

As shown here, the height of these holes 21 within the thickness of the fixing members 15 is such that they are transversely continuous with each other and, given the stiffness of the combination, do not impose any zigzag path on the cable tie 23 inserted in them.

The holes 21 in each fixing member 15 are defined by three bars 24 parallel to the support 14 and offset in the widthwise direction relative to each other to facilitate molding. The median bar 24 is offset in the heightwise direction relative to the end bars 25 and has a longitudinal rib 26 projecting from the side facing towards them in order to retain the cable tie 23.

The rib 26 has a triangular profile in transverse cross-section.

Each marker device 12A, 12B has a longitudinal flat seat 27 on its lower surface so that the other marker device 12B, 12A can be applied to it.

The seat 27 is formed by the lower surface of the stiffener rib 19 of the support 14 and those of the fixing members 15, these surfaces being continuous with each other and coplanar.

Because of the rib 19 the shoulders 18 of the support 15 are spaced from the seat 27.

The fixing members 15 are extended beyond the portion incorporating the holes 21 by a quarter-olive shape portion 28 with a large open space on its lower surface.

Figure 5:
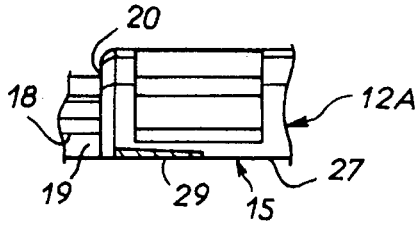
FIG. 5 is a partial view of this combination to the same scale as FIGS. 3 and 4 and in longitudinal cross-section on the line V—V in FIG. 2.
Figure 6:
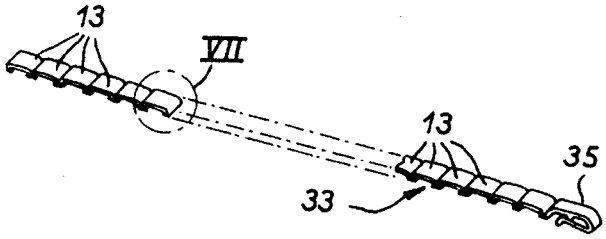
FIG. 6 is a perspective view of a necklace of markers adapted to be used on a marker device according to the invention.
Figure 7:
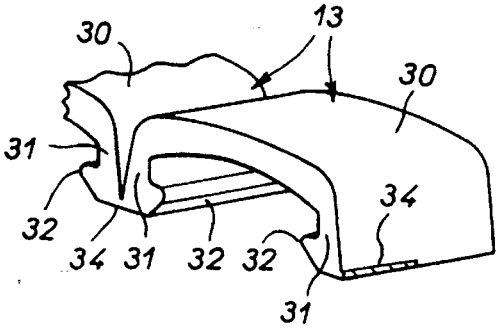
FIG. 7 shows the part of FIG. 6 identified by a circle VII to a larger scale.
Figure 8A:
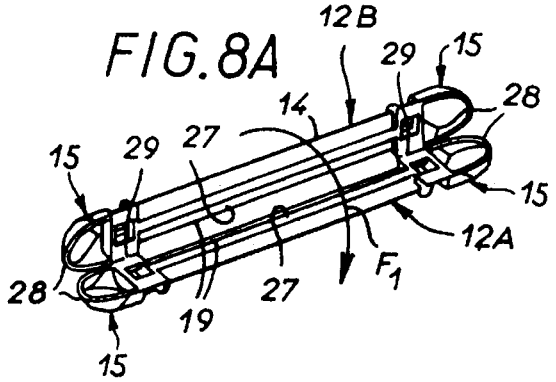
FIGS. 8A, 8B, 8C, 8D and 8E are perspective views showing various successive phases in the conjoint application of two paired marker devices according to the invention.

Each marker device 12A, 12B is in one piece with the other marker device 12B, 12A to which it is joined by a fragile link 29 (see FIGS. 5 and 8A).

The fragile link 29 joins onto one fixing member 15 and constitutes a hinge area enabling the respective seats 27 of the two marker devices 12A, 12B to be superposed.

In the embodiment specifically shown in FIGS. 1 through 9 there is a fragile link 29 for each of the fixing members 15 and it is substantially parallel to the support 14 over a fraction only of the length of the fixing members 15, starting from the guard 20 formed thereby.

To make it easier to tear through, the fragile link 29 is reduced in height from the guard 20 to the end of the fixing member 15.

The markers 13 are generally U-shape with a median part 30 and two lateral branches 31.

On their inside surface the lateral branches 31 each have a bead 32 projecting towards the other branch for clipping onto the shoulders 18 of the support 14 of a marker device 12A, 12B.

In the embodiment specifically shown in FIGS. 1 through 9 the lower surface of the median part 30 has a rounded profile in transverse cross-section, reflecting that of the transverse cross-section of the support 14 of the marker devices 12A, 12B.

The markers 13 are initially joined into a necklace 33 by their lateral branches 31. They can be detached from the necklace.

The markers 13 are linked together a fragile link 34 running along the base of their lateral branches 31, over only a fraction (for example around half) of their width.

The height of the fragile link 34 decreases from one end to the other.

One end of the necklace 33 of markers 13 forms a detachable clip 35 like the clip on a pen so that if required it can be suspended from a support.

The marker devices 12A, 12B paired in accordance with the invention can be used in the following manner, if required:

Initially (FIG. 8A), the marker devices 12A, 12B are folded together by rotation about the hinge areas provided by their fragile links 29, in the direction of the arrow F1 in FIG. 8A. As a result their seats 27 are superposed (see FIG. 8B).

The respective supports 14 of the marker devices 12A, 12B are then back-to-back.

Next (FIG. 8B) the combination of the two superposed marker devices 12A, 12B is applied transversely to the necklace 33 of markers 13 which causes one of the markers 13 from the necklace 33 to be clipped by virtue of elastic deformation onto the shoulders 18 of the support 14 of the marker device 12A, 12B when in contact with the necklace 33.

Figure 8B:
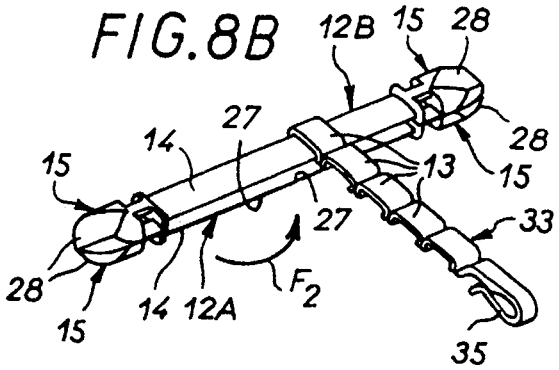
Figure 8C:
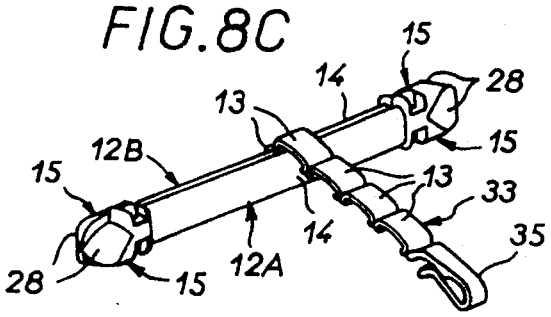

The combination of the two marker devices 12A, 12B is then rotated by one turn with a winding movement relative to the necklace 33 of markers 13, in the direction of the arrow F2 in FIG. 8B, either so that the combination of the two marker devices 12A, 12B turns on itself, as shown in the figures, or alternatively so that the necklace 33 of markers 13 is wound onto this combination.

During this relative winding movement the marker 13 previously deposited onto the support 14 of one of the two marker devices 12A, 12B is detached from the necklace 13.

Next, during the following half-turn, another marker 13 is deposited onto the support 14 of the other marker device 12B, 12A, in the same way.

Thus during each half-turn one marker 13 is deposited onto the support 14 of the marker device 12A, 12B then in contact with the necklace 33 of markers 13.

Figure 8D:
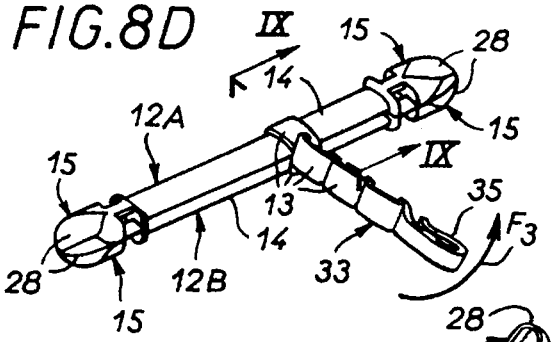

All that then remains is to separate the second marker 13 deposited in this way from the remainder of the necklace 33 by twisting the latter on itself in the direction of the arrow F3 in FIG. 8D.

Figure 9:
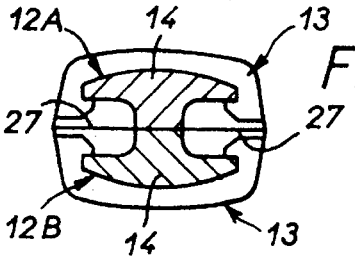
FIG. 9 is a view of two marker devices paired in this way to a larger scale and in transverse cross-section on the line IX—IX in FIG. 8D.

The two marker devices 12A, 12B then each carry the same marker 13, as shown in FIG. 9.

Figure 8E:
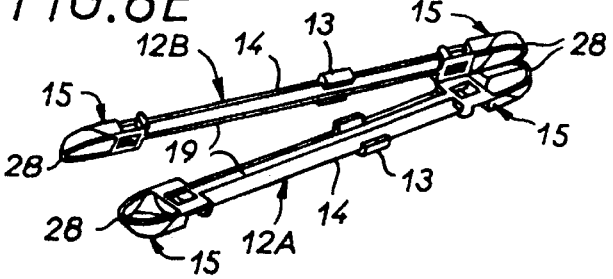

After they are separated by breaking their fragile links 29, as schematically shown in the case of one of them in FIG. 8E, the marker devices 12A, 12B can be fixed by cable ties 23 onto the cable 10 to be identified, one at one end 11A of the cable 10 and the other at its other end 11B.

To compose a more complex identifying message a plurality of markers 13 can naturally be placed side by side on the supports 14 of the marker devices 12A, 12B by the same method as described above.

Figure 10:
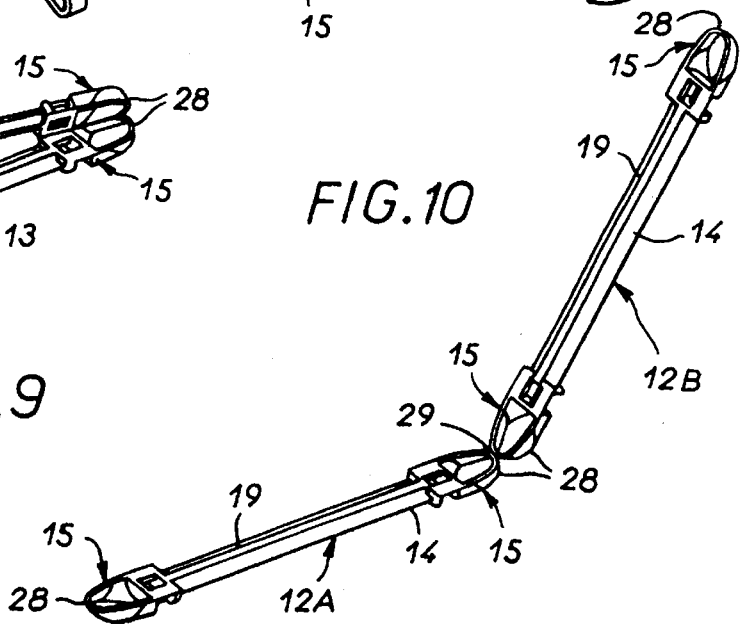
FIG. 10 is a perspective view analogous to that of FIG. 8A and relating to an alternative embodiment.

In the embodiment shown in FIG. 10 there is only one fragile link 29 at one of the fixing members 15 of the marker devices 12A, 12B and it is substantially perpendicular to their support 14.

Otherwise the design is similar to that already described, likewise the method of use.

Figure 11:
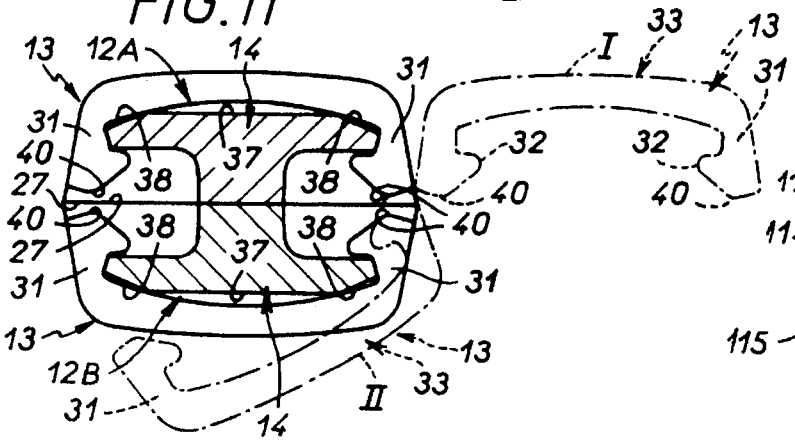
FIG. 11 is a view in transverse cross-section analogous to that of FIG. 9 to a different scale and relating to an alternative embodiment.

In the embodiment shown in FIG. 11 the lower surface of the median part of the markers 13 has a different profile in transverse cross-section from the upper surface of the support 14 of the marker devices 12A, 12B.

It has the same rounded profile as previously, but the transverse cross-section of the upper surface of the support 14 of the marker devices 12A, 12B is generally polygonal, with a median flat 37 parallel to the seat 27 and two laterals flats 38 oblique to the median flat 37 and converging towards each other in the direction away from the seat 27.

This facilitates clipping of the markers 13 onto the support 14 of the marker devices 12A, 12B.

In this embodiment each of the two lateral branches 31 of the markers 13 has a bead 40 of substantially convex transverse cross-section projecting from its lower surface.

FIG. 11 shows in continuous line two markers 13 in place on the supports 14 of two marker devices 12A and 12B and in chain-dotted line, for one of them, the initial position I in the necklace 33 and an intermediate position before it is clicked onto the support 14 of the marker device 12B.

In this intermediate position the bead 40 of the marker 13 bears on the bead 40 of the marker 13 which it adjoins at this time, rolling on the latter.

Because of their convex shape the beads 40 in contact favor separation of the markers 13.

The beads 40 extend across all the width of the lateral branches 31 of the markers 13 and their convex transverse cross-section is globally rounded.

Figure 12:
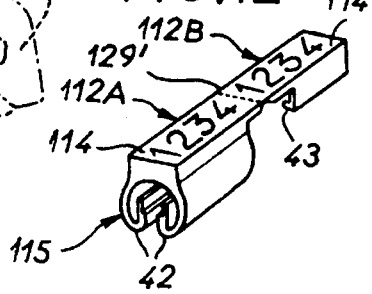
FIG. 12 is a perspective view to a different scale relating to a different application of the invention.

FIG. 12 shows the application of the invention to the situation in which the paired marker devices 112A, 112B are not identical or even of the same type, the marker devices 112A, 112B being adapted to mark different items.

For example, the marker device 112A is adapted as previously to mark a cable while the marker device 112B is adapted to mark any kind of equipment, for example a terminal block (not shown) to which the cable has to be connected.

The fixing member 115 of the marker device 112 is formed with lugs 42 adapted to engage on the cable in the same way as the jumpers and that of the marker device 112B is formed by clip lugs 43.

Fixing members 115 of this kind are well known in themselves and are not relevant to the present invention. Accordingly, they need not be described in more detail here.

Disposed end to end, the supports 114 of the marker devices 112A, 112B are joined together by a thinner zone 129 which can be cut.

The identical identifying messages are directly printed on them.

Figure 14:
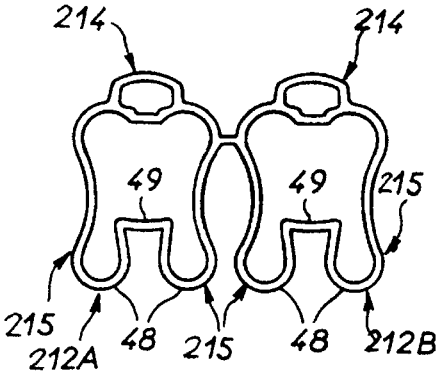
FIG. 14 is an end view of two marker devices for this latter application.
Figure 13:
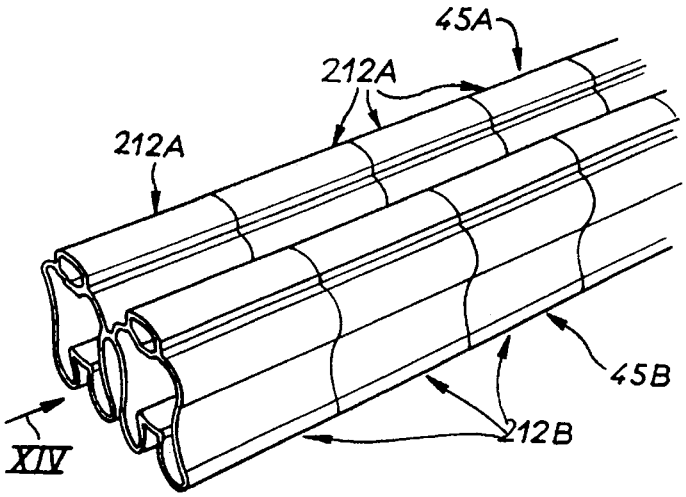
FIG. 13 is a perspective view relating to another application of the invention.
Figure 15:
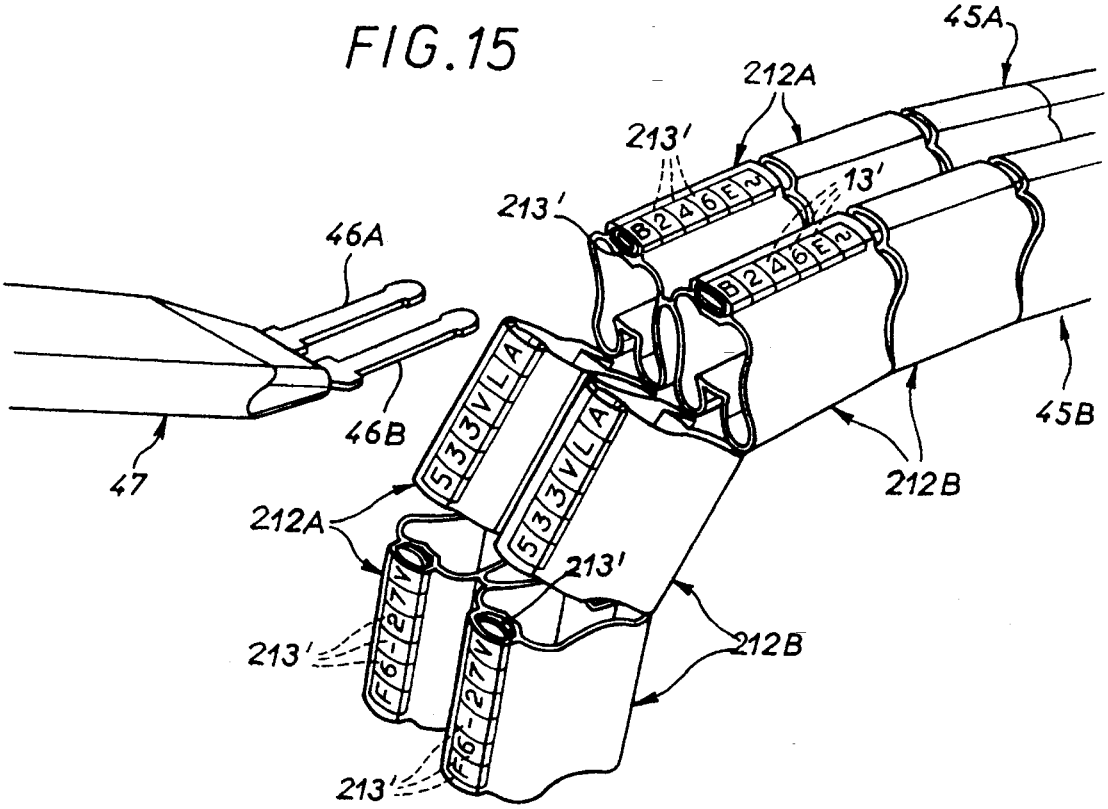
FIG. 15 is a perspective view showing one phase in the use of these marker devices.

FIGS. 13 through 15 show the application of the invention to the situation in which the two paired marker devices 212A, 212B are each formed by a respective section 45A, 45B of an extrusion.

They are identical marker devices for marking the ends of the same cable (not shown), as in the application of the invention shown in FIGS. 1 through 11.

The support 214 forms a sheath which has a substantially oval transverse cross-section and markers 213 may be inserted in it, side by side, one after the other, to make up a required identifying message.

The markers are ring-shape markers 213, for example, which to make up the identifying message can first be placed on one tooth 46A, 46B of a tool 47 used to remove them from their original support (not shown) prior to their conjoint insertion into the support 14.

The tool 47 has two teeth 46A, 46B in the embodiment shown in order to process the two marker devices 212A, 212B simultaneously, but this is not mandatory.

These arrangements are in any event well known in themselves and not relevant to the present invention. There is therefore no need to describe them in more detail here.

The fixing member 215 is obviously in one piece with the support 214, extending across all of the width of the latter, and in a manner that is also known in itself forms a sheath by means of which the assembly may be engaged on the cable.

The transverse cross-section of the fixing member 15 has two lobes 48 joined by a median bridge 49 and re-entrant at the location of the support 14.

The shape of this transverse cross-section can be different, however.

The two marker devices 212A, 212B are parallel and joined together in one piece by a fragile link 229 at the fixing member 15 and evidently extending along the entire length of the latter.

The extrusions 45A, 45B of which the two marker devices 212A, 212B are part are precut into a plurality of sections to form a sequence of marker devices 212A, 212B joined together in pairs in a detachable manner, for example.

The two extrusions are in practise extruded together.

They are made from a transparent synthetic material so that the identifying messages can be read.

The present invention is of course not limited to the embodiments described and shown but encompasses any variant execution thereof, in particular with regard to the nature and the configuration of the support to receive the markers and/or the nature, location and number of fixing members.

There is claimed:

1. Marker carrier device assembly in combination with a series of marker members, said marker carrier device assembly comprising a pair of elongate marker carrier devices detachably connected to each other and positionable in side-by-side relation, each of said marker carrier devices comprising a support having means for carrying at least one of said marker members adapted to define an identifying message, and fixing means in one piece with said support for attaching the marker carrier device to an item to be marked, said marker members being detachably connected to each other and selectively engageable with respective ones of said pair of connected marker carrier devices for loading respective marker members prior to separation of said marker carrier devices.

2. Marker carrier device assembly according to claim 1 wherein said pair of marker carrier devices are substantially identical.

3. Marker carrier device assembly according to claim 1 wherein a frangible link detachably connects the pair of marker carrier devices.

4. Marker carrier device assembly according to claim 3 wherein said frangible link terminates at said fixing means.

5. Marker carrier device assembly according to claim 1 wherein a said fixing means is disposed at each end of said support.

6. Marker carrier device assembly according to claim 1, further comprising a string of pairs of said marker carrier devices, said marker carrier devices of each said pair of marker carrier devices also being detachably connected to a corresponding one of the marker carrier devices of an adjoining pair of said marker carrier devices.

7. Marker carrier device assembly according to claim 6, wherein each said marker carrier device comprises a section of an extrusion.

8. Marker carrier assembly according to claim 7, wherein successive pairs of said marker carrier devices comprise unitary extrusions.

9. Marker carrier device assembly comprising a pair of elongate marker carrier devices, a frangible link detachably connecting the pair of marker carrier devices together so that elongate sides of said pair of marker carrier devices are in side-by-side relation, said frangible link comprising a hinge area for enabling the pair of marker carrier devices to be brought into superposed position, each of said marker carrier devices comprising a generally longitudinally extending support having means for carrying at least one marker adapted to define an identifying message, and fixing means in one piece with said support for attaching the marker carrier device to an item to be marked, whereby the pair of connected marker carrier devices may be loaded in superposed position with their respective markers prior to separation.

10. Marker carrier device assembly according to claim 9 wherein said frangible link detachably connects the pair of marker carrier devices at only one of two said fixing means located respectively at opposite ends of each said support, and said frangible link extending generally perpendicularly to said supports.

11. Marker carrier device assembly according to claim 9 wherein said frangible link detachably connects the pair of marker carrier devices at only one of two said fixing means located at adjacent ends of said supports of the pair of marker carrier devices, and said frangible link extending generally longitudinally relative to said supports.

12. Marker carrier device assembly comprising a pair of marker carrier devices detachably connected together, each of said marker carrier devices comprising a support having means for carrying at least one markers adapted to define an identifying message, and fixing means in one piece with said support for attaching the marker carrier device to an item to be marked, each of said supports comprising a substantially plane longitudinal seat so that said supports of said pair of marker carrier devices may be applied flat against each other, each of said supports also being of elongate shape with opposed longitudinal edges, said means for carrying said at least one marker member comprising longitudinal shoulders on said opposed longitudinal edges of said marker carrier devices for clipping the at least one marker member and said shoulders of each of said marker carrier devices being spaced from the plane of the respective seat.

13. Marker carrier device assembly comprising a pair of elongate marker carrier devices detachably connected to each other and extending in side-by-side relation, each of said marker carrier devices comprising a generally longitudinally extending support having means for carrying at least one marker member adapted to define an identifying message, and fixing means in one piece with said support for attaching the marker carrier device to an item to be marked, said fixing means being defined in a relatively thick-walled portion of said support, said fixing means of each of said supports comprising two holes extending transversely through the thick wall portion of the respective support for receiving a cable tie and being disposed generally in transversely continuous relation with each other.

14. Marker carrier device assembly comprising a pair of marker carrier devices detachably connected side-by-side, each of said marker carrier devices comprising a generally longitudinally extending support having means for carrying at least one marker members adapted to define an identifying message, and fixing means in one piece with said support for attaching the marker carrier device to an item to be marked, said fixing means being defined in a relatively thick-walled portion of said support, said fixing means of each of said supports comprising two holes extending transversely through the thick wall portion of the respective supports for receiving a cable tie, and being disposed generally in transversely continuous relation with each other, two holes in said fixing member being defined by three bars parallel to said support, and consisting of a median bar offset heightwise relative to two end bars, the median bar having a longitudinal rib projecting inwardly towards said end bars.

15. Method of using a marker carrier device assembly comprising the steps of: (i) providing a pair of detachably connected marker carrier devices, each of said marker carrier devices comprising a support having means for carrying at least one clip-on markers and fixing means in one piece with said support for attaching the marker carrier device to an item to be marked; (ii) providing a series of at least three clip-on markers detachably connected to one another; (iii) positioning the pair of marker carrier devices with the respective supports back-to-back to each other; (iv) transversely applying a first of the clip-on markers to the means for carrying at least one markers of a first of the pair of marker carrier devices; (v) then transversely applying a second of the clip-on markers to the means for carrying at least one markers of a second of the pair of marker carrier devices; and (vi) thereafter severing the second of the clip-on markers from an adjacent, third clip-on marker of the series.

16. Method according to claim 15, wherein one edge and then an opposite edge of the first clip-on marker is clipped to the first of the pair of marker carrier devices.

17. Method according to claim 16, wherein the second clip-on marker is swung around the second of the pair of marker carrier devices in a same angular direction as the first clip-on marker is swung around the first of the pair of carrier devices.

18. Marker carrier device assembly according to claim 9, in combination with said at least one marker, said at least one marker comprises a string of markers including first and second markers connected to each other by frangible links and adapted to be individually clipped on respective ones of said pair of marker carrier devices, each one of said string of marker markers being generally C-shaped and comprising a median portion, a pair of lateral branches extending from opposite ends of the median portion and generally in a same direction relative to the median portion, a first bead on an interior surface of one lateral branch projecting towards a first bead on another of the lateral branches, the first beads being adapted to clip onto complementary shoulders formed on one of said pair of marker carrier devices, and a second bead of generally convex cross-section disposed proximate a free end of each of said lateral branches, each said second bead being adapted to rock against said said second bead of an adjoining said marker of the string of markers for promoting separation of the said marker and the adjoining marker when clipped onto another of said pair of marker carrier devices arranged in back-to-back relation against said one of said pair of marker carrier devices on which the said first marker is clipped.

19. The combination according to claim 18, wherein an under surface of the median portion of each said marker has a transverse profile which is different from a complementary surface of each of said pair of marker carrier devices so that when the markers are clipped onto said maker carrier devices a reduced zone of contact is defined between the under surface and the complementary surface of the respective carrier devices.

* * * * *